US012781959B2

(12) United States Patent
Bowen et al.

(10) Patent No.: US 12,781,959 B2
(45) Date of Patent: Nov. 3, 2026

(54) INLET ASSEMBLY

(71) Applicant: Edwards Limited, Burgess Hill (GB)

(72) Inventors: Aaron Bowen, Clevedon (GB); Andrew James Seeley, Clevedon (GB)

(73) Assignee: Edwards Limited, Burgess Hill (GB)

( * ) Notice: Subject to any disclaimer, the term of this patent is extended or adjusted under 35 U.S.C. 154(b) by 391 days.

(21) Appl. No.: 18/577,018

(22) PCT Filed: Jul. 7, 2022

(86) PCT No.: PCT/GB2022/051747
§ 371 (c)(1),
(2) Date: Jan. 5, 2024

(87) PCT Pub. No.: WO2023/285781
PCT Pub. Date: Jan. 19, 2023

(65) Prior Publication Data

US 2024/0384869 A1 Nov. 21, 2024

(30) Foreign Application Priority Data

Jul. 13, 2021 (GB) ..... 2110051

(51) Int. Cl.
*F23G 7/06* (2006.01)

(52) U.S. Cl.
CPC ..... *F23G 7/065* (2013.01)

(58) Field of Classification Search
CPC ..... F23G 7/065
(Continued)

(56) References Cited

U.S. PATENT DOCUMENTS 4,532,914 A 8/1985 Thomas et al.
4,764,105 A 8/1988 McElroy
(Continued)

FOREIGN PATENT DOCUMENTS

CA 2629127 C 2/2011
CN 2487438 Y 4/2002
(Continued)

OTHER PUBLICATIONS

British Examination Report dated Apr. 27, 2022 and Search Report dated Apr. 12, 2022 for corresponding British Application No. GB2110048.2, 9 pages.
(Continued)

*Primary Examiner* — Vivek K Shirsat
(74) *Attorney, Agent, or Firm* — Theodore M. Magee; Westman, Champlin & Koehler, P.A.

(57) ABSTRACT

An inlet assembly includes: a combustion chamber module defining a plenum configured to supply combustion reagents to its combustion chamber, the combustion chamber module having a mount configured to interface with a common head which defines at least one gallery configured to supply the combustion reagents, the mount comprising a plurality of feed apertures positioned for fluid communication of the combustion reagents between the gallery and the plenum. In this way, a mount which is suited to its combustion chamber module interfaces with a standard or common head, which enables the combustion reagents to be supplied from the gallery of the common head via the mount and to the plenum of the combustion chamber module. This enables a common head to be used for different combustion chamber modules, which reduces the number of parts required for the assembly and maintenance of the abatement apparatus.

21 Claims, 3 Drawing Sheets

(58) Field of Classification Search
USPC ..... 431/5
See application file for complete search history.

(56) References Cited

U.S. PATENT DOCUMENTS

| | | | | |
|---|---|---|---|---|
| 5,603,905 | A | 2/1997 | Bartz et al. | |
| 6,234,787 | B1 | 5/2001 | Endoh et al. | |
| 8,293,184 | B2 | 10/2012 | Moore | |
| 10,161,628 | B2 | 12/2018 | Seeley | |
| 12,516,811 | B2 | 1/2026 | Jones et al. | |
| 2005/0135984 | A1 | 6/2005 | Ferron et al. | |
| 2007/0217983 | A1 | 9/2007 | Stanton et al. | |
| 2010/0116140 | A1 | 5/2010 | Arai et al. | |
| 2013/0287637 | A1 | 10/2013 | Vickery | |
| 2013/0305970 | A1 | 11/2013 | Kim | |
| 2014/0106282 | A1* | 4/2014 | Kim | F23G 7/065 431/5 |
| 2016/0076769 | A1* | 3/2016 | Stanton | F23G 7/06 431/75 |
| 2016/0169508 | A1 | 6/2016 | Bell | |
| 2017/0144092 | A1 | 5/2017 | Seeley | |
| 2020/0030828 | A1 | 1/2020 | Seeley et al. | |
| 2020/0038796 | A1 | 2/2020 | Fekety et al. | |
| 2021/0057236 | A1 | 2/2021 | Sekine et al. | |
| 2022/0016572 | A1 | 1/2022 | Lampert | |
| 2022/0373175 | A1 | 11/2022 | Price et al. | |

FOREIGN PATENT DOCUMENTS

| | | | |
|---|---|---|---|
| CN | 1993170 | A | 7/2007 |
| CN | 105408689 | A | 3/2016 |
| CN | 206240259 | U | 6/2017 |
| CN | 107850299 | A | 3/2018 |
| CN | 108019774 | A | 5/2018 |
| CN | 108291716 | A | 7/2018 |
| CN | 108715436 | A | 10/2018 |
| CN | 213159427 | U | 5/2021 |
| EP | 0694735 | A1 | 1/1996 |
| EP | 1129763 | A1 | 9/2001 |
| EP | 2079961 | B1 | 12/2015 |
| GB | 2550382 | A | 11/2017 |
| GB | 2584675 | A | 12/2020 |
| JP | S58184421 | U | 12/1983 |
| JP | H1054534 | A | 2/1998 |
| JP | H10148309 | A | 6/1998 |
| JP | 2005522660 | A | 7/2005 |
| JP | 2006170603 | A | 6/2006 |
| JP | 2008519959 | A | 12/2008 |
| JP | 2016011759 | A | 1/2016 |
| JP | 2017211100 | A | 11/2017 |
| JP | 2021502518 | A | 1/2021 |
| TW | 201138931 | A | 11/2011 |
| TW | 201418629 | A | 5/2014 |
| WO | 0161245 | A1 | 8/2001 |
| WO | 2007053626 | A2 | 5/2007 |
| WO | 2008122819 | A1 | 10/2008 |
| WO | 2010054291 | A1 | 5/2010 |
| WO | 2016156811 | A1 | 10/2016 |
| WO | 2017037419 | A1 | 3/2017 |
| WO | 2018129111 | A1 | 7/2018 |
| WO | 2023285778 | A1 | 1/2023 |
| WO | 2023285779 | A1 | 1/2023 |
| WO | 2023285780 | A1 | 1/2023 |

OTHER PUBLICATIONS

PCT Notification of Transmittal of the International Search Report and the Written Opinion of the International Searching Authority, or the Declaration and PCT Search Report dated Sep. 21, 2022 for corresponding PCT application Serial No. PCT/GB2022/051745, 11 pages.

British Examination Report dated Apr. 8, 2022 and Search Report dated Apr. 1, 2022 for corresponding British Application No. GB2110049.0, 10 pages.

PCT Notification of Transmittal of the International Search Report and the Written Opinion of the International Searching Authority, or the Declaration and PCT Search Report dated Sep. 21, 2022 for corresponding PCT application Serial No. PCT/GB2022/051746, 11 pages.

British Examination Report dated Apr. 27, 2022 and Search Report dated Apr. 12, 2022 for corresponding British Application No. GB2110051.6, 11 pages.

PCT Notification of Transmittal of the International Search Report and the Written Opinion of the International Searching Authority, or the Declaration and PCT Search Report dated Sep. 28, 2022 for corresponding PCT application Serial No. PCT/GB2022/051747, 12 pages.

British Examination Report dated Apr. 8, 2022 and Search Report dated Apr. 6, 2022 for corresponding British Application No. GB2110047.4, 10 pages.

PCT Notification of Transmittal of the International Search Report and the Written Opinion of the International Searching Authority, or the Declaration and PCT Search Report dated Sep. 21, 2022 for corresponding PCT application Serial No. PCT/GB2022/051744, 11 pages.

Japanese Notification of Reason for Rejection dated Feb. 17, 2025 for corresponding Japanese application Serial No. 2024-501172, 7 pages.

Japanese Notification of Reason for Rejection dated Feb. 27, 2025 for corresponding Japanese application Serial No. 2024-501522, 9 pages.

Japanese Notification of Reason for Rejection dated Mar. 24, 2025 for corresponding Japanese application Serial No. 2024-501521, 7 pages.

Chinese Search Report dated Apr. 15, 2026 and Office Action dated Apr. 16, 2026 for Chinese application No. 202280049687.0, Chinese Search Report dated Apr. 14, 2026 and Office Action dated Apr. 15, 2026 for Chinese application No. 202280049686.6, Chinese Search Report dated Mar. 19, 2026 and Office Action dated Mar. 25, 2026 for Chinese application No. 202280049674.3, 32 pages.

Notice of Allowance dated Jun. 2, 2026 for U.S. Appl. No. 18/578,171, Amendment dated Jun. 17, 2026 and Office Action dated Mar. 23, 2026 for U.S. Appl. No. 18/578,171, Office Action dated Apr. 8, 2026 and Amendment dated Jul. 2, 2026 for U.S. Appl. No. 18/578,171, 100 pages.

Taiwanese Search Report dated Apr. 2, 2026 and Office Action dated Apr. 8, 2026 for Taiwanese application No. 111125527, Taiwanese Search Report dated for Taiwanese application No. 111125451, 14 pages.

* cited by examiner

INLET ASSEMBLY

CROSS-REFERENCE OF RELATED APPLICATION

This application is a Section 371 National Stage Application of International Application No. PCT/GB2022/051747, filed Jul. 7, 2022, and published as WO 2023/285781A1 on Jan. 19, 2023, the content of which is hereby incorporated by reference in its entirety and which claims priority of British Application No. 2110051.6, filed Jul. 13, 2021.

FIELD

The field of the invention relates to an inlet assembly, an abatement apparatus and a method.

BACKGROUND

Abatement apparatus, such as radiant burners or other types of abatement apparatus, are known and are typically used for treating an effluent gas stream from a manufacturing processing tool used in, for example, the semiconductor or flat panel display manufacturing industry. During such manufacturing, residual perfluorinated compounds (PFCs) and other compounds exist in the effluent gas stream pumped from the process tool. PFCs are difficult to remove from the effluent gas and their release into the environment is undesirable because they are known to have relatively high greenhouse activity.

Known radiant burners use combustion to remove the PFCs and other compounds from the effluent gas stream, such as that described in EP 0 694 735. Typically, the effluent gas stream is a nitrogen stream containing PFCs and other compounds. The effluent stream is conveyed into a combustion chamber that is laterally surrounded by the exit surface of a foraminous gas burner. In some cases treatment materials, such as fuel gas, can be mixed with the effluent gas stream before entering the combustion chamber. Fuel gas and air are simultaneously supplied to the foraminous burner to affect combustion at the exit surface. The products of combustion from the foraminous burner react with the effluent stream mixture to combust compounds in the effluent stream.

Although arrangements of abatement apparatus exist, they each have their own shortcomings. Accordingly, it is desired to provide an improved arrangement for abatement apparatus.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided an inlet assembly for an abatement apparatus for treating an effluent stream from a semiconductor processing tool, the inlet assembly comprising: a combustion chamber module defining a plenum configured to supply combustion reagents to its combustion chamber, the combustion chamber module having a mount configured to interface with a common head which defines at least one gallery configured to supply the combustion reagents, the mount comprising a plurality of feed apertures positioned for fluid communication of the combustion reagents between the gallery and the plenum.

The first aspect recognizes that a problem with abatement apparatus is that each combustion chamber needs to be carefully configured to suit the effluent stream flow rates and types to ensure adequate abatement. This means that a variety of, often bespoke, parts are required to be produced in order to provide an abatement apparatus suitable to be operated under a variety of different conditions. For example, the arrangement of the delivery nozzles which deliver the effluent stream into the abatement chamber can vary, depending on the effluent stream and/or its flow rate. Also, the size of the abatement chambers can vary. Having differing configuration delivery nozzles and abatement chambers can be problematic since this can lead to requiring different configuration parts, which increases the inventory of parts required to produce and maintain such abatement apparatus.

Accordingly, an inlet assembly is provided. The inlet assembly may be for an abatement apparatus. The abatement apparatus may treat an effluent stream from a semiconductor processing tool. The inlet assembly may comprise a combustion chamber module. The combustion chamber module may define a plenum. The plenum may be configured or arranged to supply combustion reagents to a combustion chamber of the combustion chamber module. The combustion chamber module may have a mount. The mount may be configured to interface with or connect to a common head. The common head may define at least one gallery or chamber. The gallery may be configured or arranged to supply the combustion reagents. The mount may comprise a plurality of feed apertures. The feed apertures may be positioned or located to provide fluid communication of the combustion reagents between the gallery and the plenum. In this way, a mount which is suited to its combustion chamber module interfaces with a standard or common head, which enables the combustion reagents to be supplied from the gallery of the common head via the mount and to the plenum of the combustion chamber module. This enables a common head to be used for different combustion chamber modules, which reduces the number of parts required for the assembly and maintenance of the abatement apparatus.

The plenum may surround the combustion charge chamber. The feed apertures may be located to overlie or align with the plenum. Hence, the feed apertures may be positioned to align with the plenum.

The feed apertures may be located to extend or be positioned around a perimeter or periphery of the mount.

The inlet assembly may comprise a plurality of combustion chamber modules. Each combustion chamber module may have a mount which is configured to interface with a corresponding one of a plurality of galleries of the common head. Each mount may comprise a plurality of feed apertures positioned for fluid communication of the combustion reagents between that gallery and a corresponding plenum. Hence, the common head may be provided with a number of separate galleries, each of which supplies combustion reagents do a corresponding combustion chamber module through its mount. This enables each combustion chamber module to be fed independently of the others.

The mount of at least one combustion chamber module may be configured or arranged to interface or connect with a plurality of galleries of the common head. The mount may comprise a plurality of feed apertures which are positioned or located for fluid communication of the combustion reagents between those galleries and its plenum. Hence, more than one gallery within the common head may feed a combustion chamber module. This may enable the combustion chamber module to be supplied with an increased amount of combustion reagents.

Each combustion chamber module may be configured or arranged to receive or have located therewithin at least one effluent stream nozzle which may extend from the common head. The feed apertures may be located to avoid a position of each effluent stream nozzle. Hence, effluent stream nozzles may extend through the common head and through the mount, with the feed apertures being positioned away from the location of the effluent stream nozzles.

The mount may define at least one effluent stream nozzle aperture. The effluent stream nozzle aperture may be positioned or located to receive a corresponding effluent stream nozzle. Hence, the effluent stream nozzle may extend from the common head and through the mount to the combustion chamber.

The mount may comprise at least one effluent stream nozzle seal which is positioned to surround each corresponding effluent stream nozzle.

Each effluent stream nozzle seal may be configured to fluidly isolate a corresponding effluent stream nozzle from the combustion reagents.

The combustion chamber module may comprise at least one effluent stream nozzle seal grove which is configured to receive a corresponding effluent stream nozzle seal.

The feed apertures may be located or positioned to avoid each effluent stream nozzle seal.

The mount may comprise a perimeter seal which may be configured to contain the combustion reagents.

The common head may be configured to removably provide at least one additional effluent stream nozzle for enhanced combustion chamber modules. The nozzle may extend from the common head. Hence, the common head may provide additional effluent stream nozzles when required, but those additional effluent stream nozzles may be removed when they are not required. This enables the common head to support different types of combustion chamber modules.

The combustion chamber module may be an enhanced combustion module. The mount may be configured to receive at least one additional effluent stream nozzle extending from the common head. The feed apertures may be located to avoid a position of each additional effluent stream nozzle. Hence, the feed apertures are positioned away from the location of any of the effluent stream nozzles that may extend from the common head.

The mount of the enhanced combustion chamber module may be configured or arranged to receive a plurality of effluent stream nozzles extending from the common head.

The mount of the enhanced combustion chamber module may be configured or arranged to interface with a plurality of galleries of the common head.

The combustion chamber module may be other than the enhanced combustion chamber module. When this is the case, the perimeter seal may be located to deviate to avoid a location of the at least one additional stream nozzle.

The mount of the other than the enhanced combustion chamber module may be configured or arranged to receive a single effluent steam nozzle extending from the common head.

The mount of the other than the enhanced combustion chamber module may be configured to interface with a single gallery of the common head.

Each perimeter seal may follow a joggling or non-linear path to avoid at least one additional effluent stream nozzle.

The feed apertures may be positioned to avoid the perimeter seal.

The feed apertures may be located to follow a deviating path extending around the perimeter of the mount.

The inlet assembly may comprise the common head having an inlet configured to feed the combustion reagents effluent stream to the gallery.

The inlet assembly may comprise the common head to having a plurality of inlets configured to feed the effluent to a corresponding plurality of galleries.

The inlet assembly may comprise the combustion chamber modules.

The inlet assembly may comprise the effluent stream nozzle.

The combustion chamber module may comprise a foraminous sleeve configured or arranged to define the combustion chamber.

According to a second aspect, there is provided an abatement apparatus comprising the inlet assembly of the first aspect.

The abatement apparatus may comprise the features of the inlet assembly set out above.

According to a third aspect, there is provided a method, comprising: providing a combustion chamber module defining a plenum configured to supply combustion reagents to its combustion chamber and a mount configured to interface with a common head which defines at least one gallery configured to supply the combustion reagents; and providing the mount with a plurality of feed apertures positioned for fluid communication of the combustion reagents between the gallery and the plenum.

The method may comprise surrounding the combustion chamber with the plenum surrounds and locating the feed apertures to overlie the plenum.

The method may comprise locating the feed apertures to extend around a perimeter of the mount.

The method may comprise providing a plurality of the combustion chamber modules; configuring each mount to interface with a corresponding one of a plurality of galleries of the common head; and positioning a plurality of feed apertures of each mount for fluid communication of the combustion reagents between that gallery and a corresponding plenum.

The method may comprise configuring the mount of at least one combustion chamber module to interface with a plurality of galleries of the common head and positioning a plurality of feed apertures positioned of the mount for fluid communication of the combustion reagents between those galleries and its plenum.

The method may comprise configuring each combustion chamber module to receive at least one effluent stream nozzle extending from the common head and locating the feed apertures to avoid a position each effluent stream nozzle.

The method may comprise defining at least one effluent stream nozzle aperture with the mount defines and positioning the at least one effluent stream nozzle aperture to receive a corresponding effluent stream nozzle.

The method may comprise providing the mount with at least one effluent stream nozzle seal and positioning the at least one effluent stream nozzle seal to surround each corresponding effluent stream nozzle.

The method may comprise configuring each effluent stream nozzle seal to fluidly isolate a corresponding effluent stream nozzle from the combustion reagents.

The method may comprise receiving an effluent stream nozzle seal in a corresponding at least one effluent stream nozzle seal groove.

The method may comprise locating the feed apertures to avoid each effluent stream nozzle seal.

The method may comprise providing the mount with a perimeter seal and configuring the perimeter seal to contain the combustion reagents.

The method may comprise configuring the common head to removably provide at least one additional effluent stream nozzle extending from the common head for enhanced flow combustion chamber modules.

The method may comprise providing the combustion chamber module as an enhanced combustion chamber module, configuring the mount to receive at least one additional effluent stream nozzle extending from the common head and locating feed apertures to avoid a position each additional effluent stream nozzle.

The method may comprise configuring the mount of the enhanced combustion chamber module to receive a plurality of effluent stream nozzles extending from the common head.

The method may comprise configuring the mount of the enhanced combustion chamber module to interface with a plurality of galleries of the common head.

The method may comprise, when the combustion chamber module is other than the enhanced combustion chamber module, deviating the perimeter seal to avoid a location of the at least one additional effluent stream nozzle.

The method may comprise configuring the mount of the other than the enhanced combustion chamber module to receive a single effluent stream nozzle extending from the common head.

The method may comprise configuring the mount of the other than the enhanced combustion chamber module to interface with a single gallery of the common head.

The method may comprise following joggling path with each perimeter seal to avoid the at least one additional effluent stream nozzle.

The method may comprise positioning the feed apertures to avoid the perimeter seal.

The method may comprise locating the feed apertures to follow a deviating path extending around the perimeter of the mount.

The method may comprise providing the common head having an inlet configured to feed the combustion reagents to the gallery.

The method may comprise providing the common head having a plurality of inlets configured to feed the combustion reagents to a corresponding plurality of galleries.

The method may comprise providing the combustion chamber modules.

The method may comprise providing the effluent stream nozzle.

The method may comprise providing the combustion chamber module comprising a foraminous sleeve configured to define the combustion chamber.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided. Embodiments provide an arrangement which utilises one or more common head configurations which can be used to support different types of combustion chamber modules. The common head is provided with at least one aperture through which inlet nozzles extend to convey one or more effluent streams to the combustion chambers of the combustion chamber modules. The common head at least partially defines one or more galleries into which combustion reagents are provided. Each combustion chamber module is provided with a mount which interfaces that combustion chamber module to the common head. The mount is provided with at least one aperture through which the inlet nozzles pass to allow full fluid communication of the effluent stream into the combustion chamber of that combustion chamber module. The combustion chamber is typically defined by a foraminous sleeve which defines a plenum between that foraminous sleeve and a housing of the combustion chamber module which is used to convey the combustion reagents for ignition on an inner surface of the sleeve, within the combustion chamber. The mount is provided with feed apertures which feed the combustion reagents from the gallery and into the plenum. These feed apertures are located on the mount at positions which both overlie the plenum and avoid the location of other structures within the common head, such as inlet nozzles, sight glasses, pilot feeds, purge feeds and the like. This enables combustion chamber modules and mounts of different configurations to be assembled with a common head which helps to reduce the inventory of parts required for different configurations of abatement apparatus.

Abatement Apparatus

Figure 1:
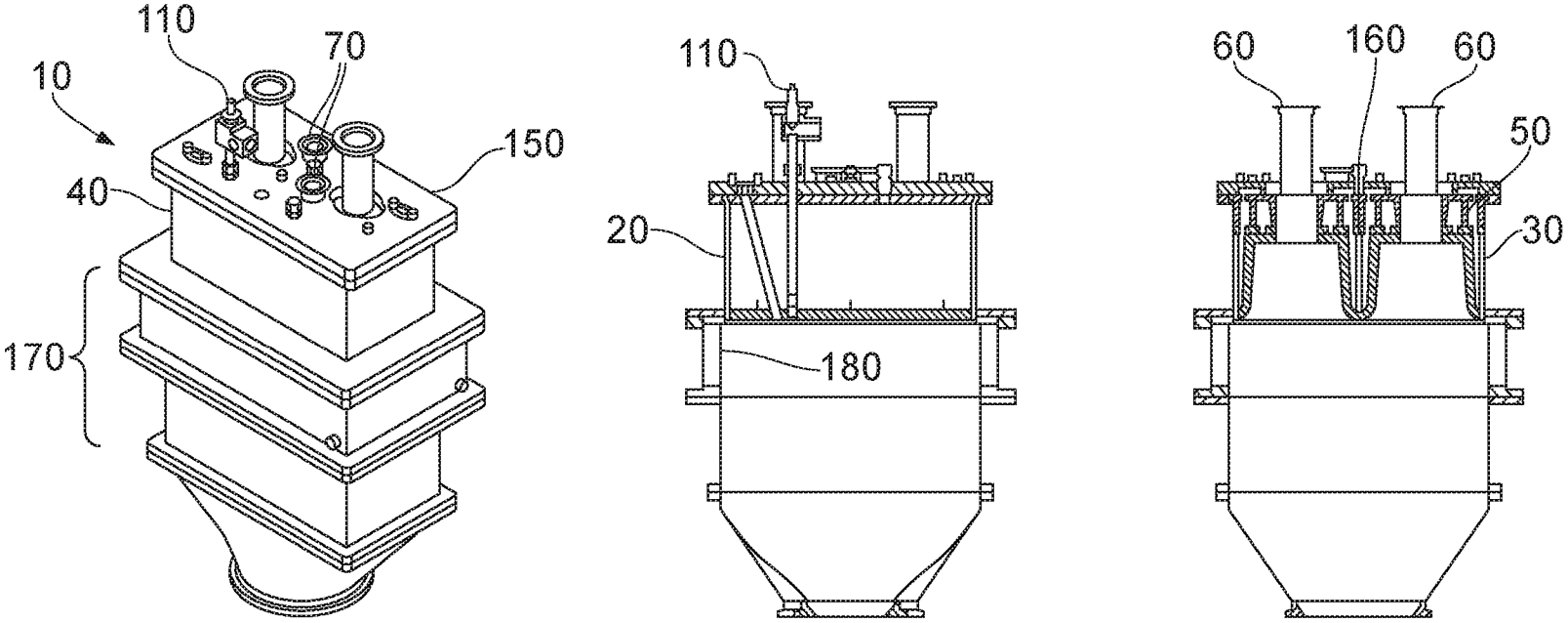
FIG. 1A-C are sectional perspective views of components of a modular abatement apparatus according to one embodiment.

FIG. 1A is a perspective view of components of a modular abatement apparatus 10 according to one embodiment. FIG. 1B is a sectional view through FIG. 1A providing a sectional view of a pilot module 20. FIG. 1C is a cross-sectional view through FIG. 1A providing a sectional view of the combustion chamber modules 30. FIG. 1D is sectional view showing the combustion chamber modules 30 in more detail.

A housing 40 is provided which defines a common housing chamber within which combustion chamber modules 30 are provided (label also in FIG. 1C). A common head 150 is provided which covers an upstream opening of the housing 40. The head 150 receives effluent stream inlets 60 for supplying an effluent stream, combustion reagent inlets 70 for supplying combustion reagents such as fuel, a pilot module inlet 110 for supplying fuel and a purge inlet 160 for supplying an inter-module purge gas such as nitrogen. Downstream of the housing 40 is a weir 170 which defines a wetted wall chamber 180 which in operation has walls over which a fluid such as water flows. In this example, there are two combustion chamber modules 30 arranged linearly within the housing 40, however as will be explained in more detail below, different configurations of combustion chamber modules 30 are possible which share a common housing and common head.

Between the head 150 and the combustion chamber modules 30 is provided a mount 50 which retains the combustion chamber modules 30 in place within the housing 40. The depth of this mount 50 can vary to accommodate different length combustion chamber modules 30 while still ensuring that each combustion chamber modules 30 discharges at the same position into the weir 170.

The combustion chamber module 30 has a module housing 80 within which is fitted a foraminous sleeve 90. The foraminous sleeve 90 defines a combustion chamber 120 within which the supplied effluent stream is treated. Each combustion chamber module 30 is provided with an effluent stream inlet 60 which conveys an effluent stream to be treated into the combustion chamber of that combustion chamber module 30. The foraminous sleeve 90 is spaced away slightly from the module housing 80 to define a plenum 100. Combustion reagent inlets 70 convey treatment materials such as fuel through the mount 50 and into the plenum 100 of the respective combustion chamber module 30. Hence, each combustion chamber module 30 is essentially self-contained and its operation has no effect on other combustion chamber modules 30 within the housing 40.

Figure 2:
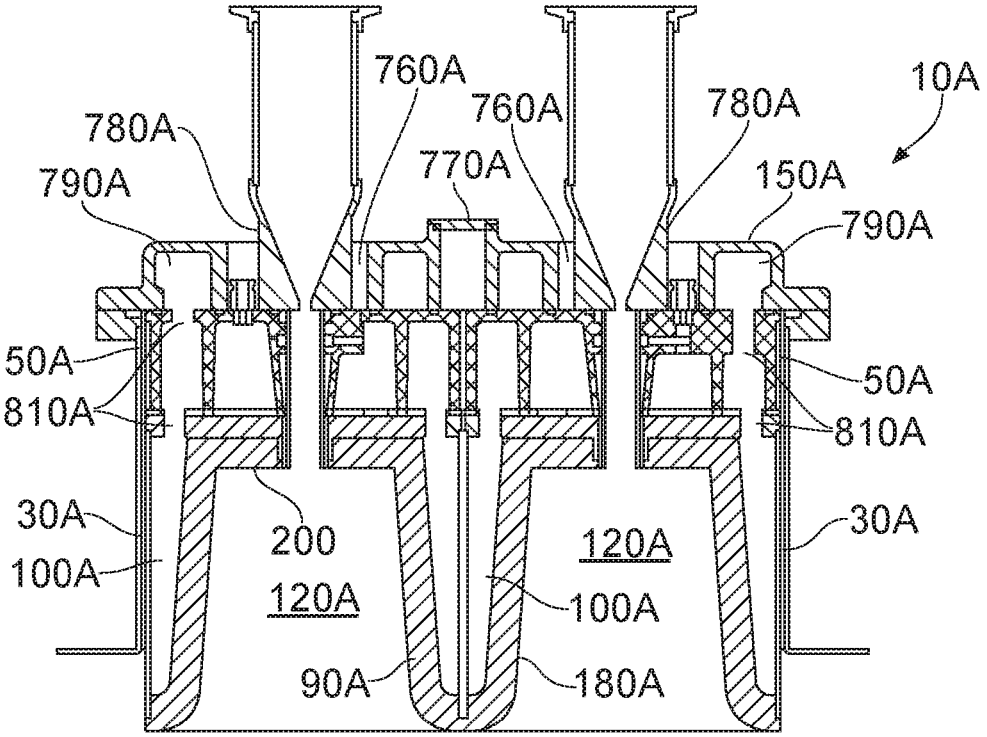
FIG. 2 illustrates components of an abatement apparatus according to one embodiment.

FIG. 2 illustrates components of an abatement apparatus 10A according to one embodiment. A common head 150A is provided which defines apertures 760A, 770A, which are dimension to receive inlet assemblies. In this example, the apertures 760A receive an inlet assembly 780A, while the aperture 770A is unused and so remains unfiled or blanked off. The common head 150A defines a gallery 790A which has an inlet (not shown) which receives combustion reagents, in this case fuel and an oxidant.

A pair of mounts 50A are provided which attach to the downstream surface of the common head 150A. Each mount 50A is provided with feed apertures 810A which extend through the mount 50A. A combustion chamber module 30A attaches to the downstream surface of each mount 50A. The combustion chamber module 30A has an aperture which receives the inlet assembly 780A. The combustion chamber module 30A also contains a foraminous sleeve 90A which has an upstream ceiling 200 and depending, diverging walls 180A which define a combustion chamber 120A. An outer surface of the foraminous sleeve 90A and an inner surface of a housing retaining the combustion chamber module 30A defines a plenum 100A. The feed apertures 810A are located to overlie the plenum 100A.

Figure 3:
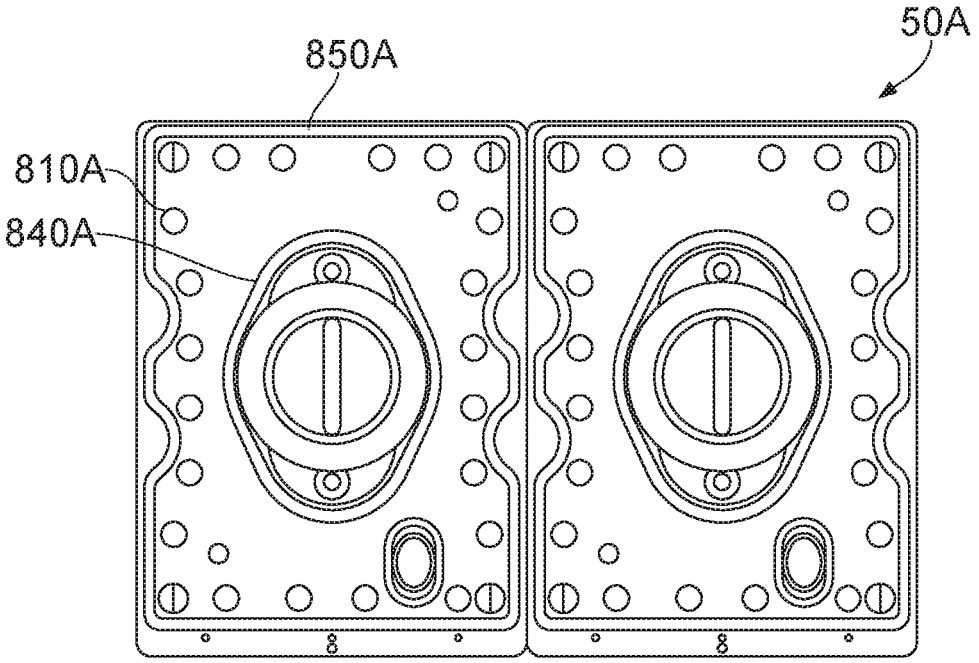
FIG. 3 illustrates the mounts in more detail according to one embodiment.

FIG. 3. illustrates the mounts 50A in more detail. Each mount 50A is provided with a seal 840A which surrounds the inlet assembly 780A and cooperates with the common head 150A. Additionally, a peripheral seal 850A extends around the perimeter of the mount 50A and also cooperates with the common head 150A. These seals 840A, 850A in cooperation with the common head 150A retain the combustion reagents in the area between the seals, within the gallery 790A. Hence, all of the feed apertures 810A are located between these seals 840A, 850A and are each supplied with combustion reagents. The feed apertures 810A are located generally around the perimeter of the mount 50A to overlie an upstream portion of the plenum 100A. However, in order to avoid the location of the apertures 770A (which in this case are unused), both the feed apertures 810A and the peripheral seal 850A deviates away from the location of the apertures 770A. That is to say that the feed apertures 810A and the peripheral seal 850A are positioned along a joggling, non-linear path in the vicinity of the apertures 770A.

Figure 4:
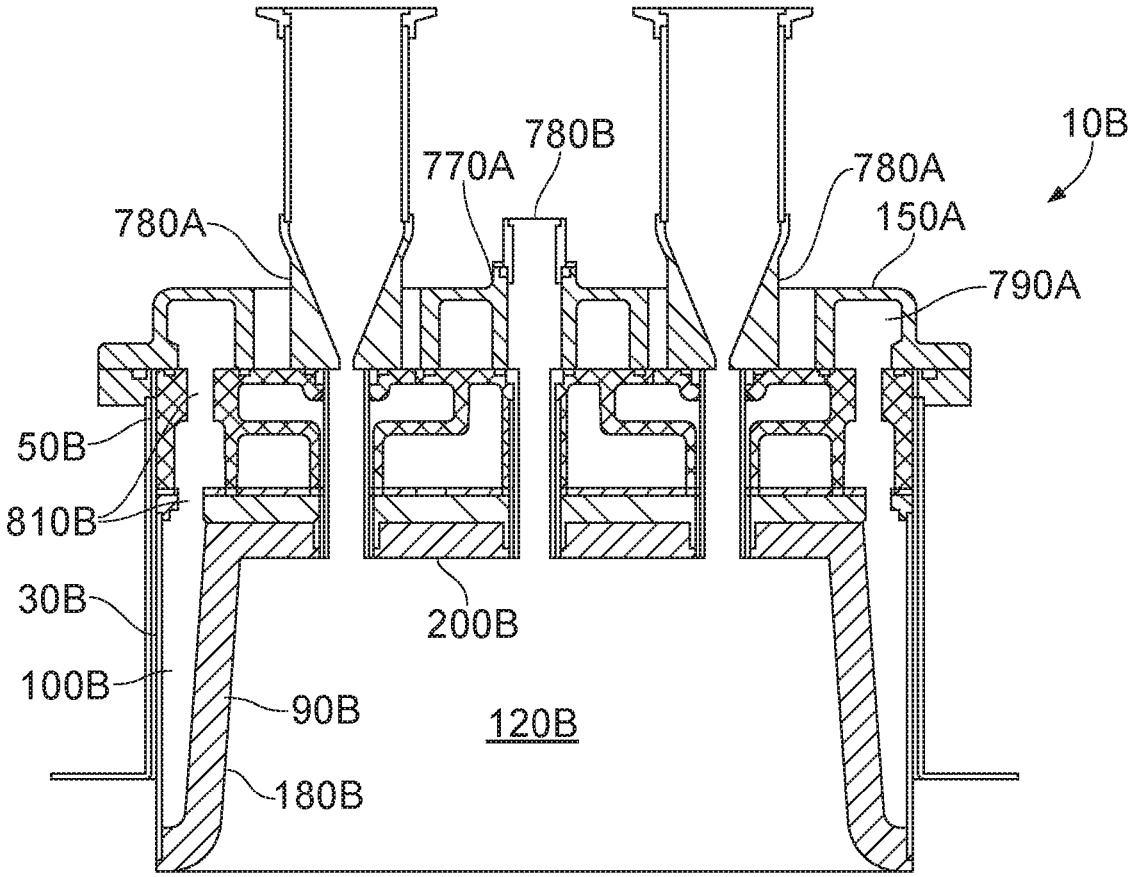
FIG. 4 illustrates components of an abatement apparatus according to one embodiment.

FIG. 4 illustrates components of an abatement apparatus 10B according to one embodiment. This arrangement is similar to that described above and has the same common head 150A. However, in this arrangement further inlet assemblies 780B are provided which are received by the apertures 770A and a single mount 50B is provided which retains a single combustion chamber module 30B.

The mount 50B attaches to the downstream surface of the common head 150A. The mount 50B is provided with feed apertures 810B which extend through the mount 50B. The combustion chamber module 30B attaches to the downstream surface of the mount 50B. The combustion chamber module 30B has apertures which receives the inlet assemblies 780A, 780B. The combustion chamber module 30B also contains a foraminous sleeve 90B which has an upstream ceiling 200B and depending, diverging walls 180B which define a combustion chamber 120B. An outer surface of the foraminous sleeve 90B and an inner surface of a housing retaining the combustion chamber module 30B defines a plenum 100B. The feed apertures 810B are located to overlie the plenum 100B.

Figure 5:
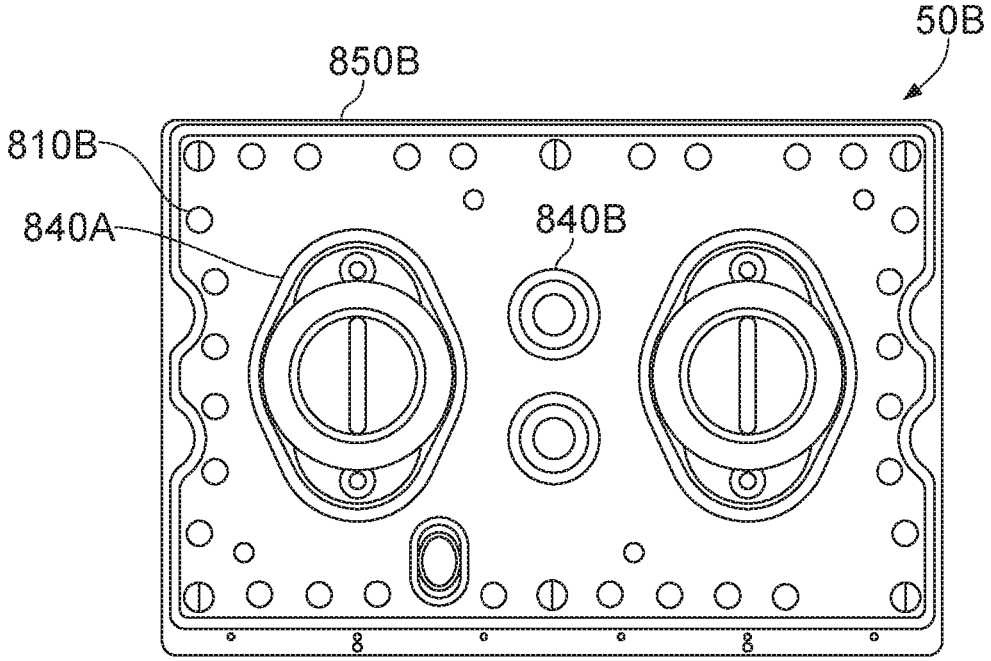
FIG. 5 illustrates the mounts in more detail according to one embodiment.

FIG. 5. illustrates the mount 50B in more detail. The mount 50B is provided with a seal 840A which surrounds the inlet assemblies 780A and a seal 840B which surrounds the inlet assemblies 780B and cooperates with the common head 150A. Additionally, a peripheral seal 850B extends around the perimeter of the mount 50B and also cooperates with the common head 150A. These seals 840A, 840B, 850B in cooperation with the common head 150A retain the combustion reagents in the area between the seals, within the gallery 790A. Hence, all of the feed apertures 810B are located between these seals 840A, 840B, 850B and are each supplied with combustion reagents. The feed apertures 810B are located generally around the perimeter of the mount 50B to an overlie an upstream portion of the plenum 100B. However, both the feed apertures 810B and the peripheral seal 850B also deviate away from a possible location of further apertures. That is to say that the feed apertures 810B and the peripheral seal 850B are positioned along a joggling, non-linear path in the vicinity of the possible location of further apertures.

Hence, it can be seen that different configuration combustion chamber modules can be attached to the same common head using different configuration mounts, without interfering with the supply of combustion reagents to their plenum(s).

Some embodiments provide a modular architecture for abatement systems which allows standard burner elements to be tessellated to form an array of different system configurations. This provides a harmonised design whereby combinations and permutations of burner elements can form a leak-tight seal to a common head, thereby reducing inventory and allowing upgrade/future proofing.

Unlike existing approaches which required a different head for each combination and permutation of modules since there is overlap between the inter-module purge region with premix supply regions and both of these coincide with the positions of the auxiliary inlets on a double width module, some embodiments provide a new geometry that circumvents these problems, allowing a significant reduction in cost/complexity/design work.

Joggling the seal groove and relocating a number of fuel-air premix ports allows commonality of seal locations. In particular, the seals around the auxiliary inlets in a double module coincide with the joggles in the peripheral sealing groove.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. An inlet assembly for an abatement apparatus for treating an effluent stream from a semiconductor processing tool, said inlet assembly comprising:

a plurality of combustion chamber modules, each combustion chamber module defining a respective plenum configured to supply combustion reagents to a respective combustion chamber of the combustion chamber module, and each combustion chamber module having a respective mount configured to interface with a corresponding one of a plurality of galleries of a common head, each gallery configured to supply said combustion reagents, said respective mount comprising a plurality of feed apertures positioned for fluid communication of said combustion reagents between said corresponding one gallery of said plurality of galleries and said respective plenum.

2. The inlet assembly of claim 1, wherein for each combustion chamber module, said respective plenum surrounds said respective combustion chamber and said plurality of feed apertures of said respective mount are located to overlie said respective plenum.

3. The inlet assembly of claim 1, wherein for each combustion chamber module, said plurality of feed apertures are located to extend around a perimeter of said respective mount.

4. The inlet assembly of claim 1, wherein said respective mount of at least one combustion chamber module is configured to interface with multiple galleries of the plurality of galleries of said common head, wherein the plurality of feed apertures of said respective mount comprise at least one feed aperture for each of the multiple galleries such that each feed aperture for each of the multiple galleries is positioned for fluid communication of said combustion reagents between a respective one of the multiple galleries and a respective plenum of the at least one combustion chamber module.

5. The inlet assembly of claim 1, wherein each combustion chamber module of the plurality of combustion chamber modules is configured to receive at least one effluent stream nozzle extending from said common head and said plurality of feed apertures of each respective mount are located to avoid a position of each effluent stream nozzle.

6. The inlet assembly of claim 1, wherein each respective mount defines at least one effluent stream nozzle aperture positioned to receive a corresponding effluent stream nozzle.

7. The inlet assembly of claim 1, wherein each respective mount comprises at least one effluent stream nozzle seal positioned to surround each corresponding effluent stream nozzle.

8. The inlet assembly claim 7, wherein said plurality of feed apertures of each respective mount are located to avoid each effluent stream nozzle seal.

9. The inlet assembly of claim 1, wherein each respective mount comprises a perimeter seal configured to contain said combustion reagents.

10. The inlet assembly of claim 1, wherein said common head is configurable to removably provide at least one additional effluent stream nozzle extending from said common head for enhanced combustion chamber modules.

11. The inlet assembly of claim 5, wherein at least one of said plurality of combustion chamber modules is an enhanced combustion chamber module, said respective mount of the enhanced combustion chamber module being configured to receive at least two effluent stream nozzles extending from said common head and said plurality of feed apertures of said respective mount of the enhanced combustion chamber module being located to avoid a position of the at least two effluent stream nozzles.

12. The inlet assembly of claim 11, wherein said respective mount of said enhanced combustion chamber module is configured to interface with multiple galleries of the plurality of galleries of said common head.

13. The inlet assembly of claim 11, wherein at least one combustion chamber module of the plurality of combustion chamber modules other than said enhanced combustion chamber module comprises a perimeter seal that deviates to avoid a location of one of at least two additional effluent stream nozzles of the enhanced combustion chamber module.

14. The inlet assembly of claim 11, wherein said respective mount of said at least one combustion chamber module of the plurality of combustion chamber modules other than said enhanced combustion chamber module is configured:

to receive a single effluent stream nozzle extending from said common head; and to interface with a single gallery of said plurality of galleries of said common head.

15. The inlet assembly of claim 9, wherein said perimeter seal of each respective mount follows a joggling path to avoid at least one effluent stream nozzle.

16. The inlet assembly of claim 9, wherein each feed aperture of said plurality of feed apertures of each respective mount are at least one of:

positioned to avoid said perimeter seal of said respective mount; and located to follow a deviating path extending around said perimeter of said respective mount.

17. The inlet assembly of claim 1, further comprising:

said common head having a plurality of inlets configured to feed said combustion reagents to said plurality of galleries;

and a plurality of effluent stream nozzles.

18. The inlet assembly of claim 1, wherein each combustion chamber module comprises a foraminous sleeve configured to define said respective combustion chamber of the combustion chamber module.

19. An abatement apparatus comprising the inlet assembly of claim 1.

20. A method, comprising:

providing a plurality of combustion chamber modules, each combustion chamber module defining a respective plenum configured to supply combustion reagents to a respective combustion chamber of the combustion chamber module and a respective mount configured to interface with a corresponding one of a plurality of galleries of a common head, each gallery of the plurality of galleries configured to supply said combustion reagents; and providing each respective mount with a plurality of feed apertures positioned for fluid communication of said combustion reagents between at least one gallery of said plurality of galleries and said respective plenum.

21. An inlet assembly for an abatement apparatus for treating an effluent stream from a semiconductor processing tool, said inlet assembly comprising:

a combustion chamber module defining a plenum configured to supply combustion reagents to its combustion chamber, said combustion chamber module having a mount configured to interface with a common head which defines at least one gallery configured to supply said combustion reagents, said mount comprising a plurality of feed apertures positioned for fluid communication of said combustion reagents between said gallery and said plenum wherein said mount comprises a perimeter seal configured to contain said combustion reagents, wherein the perimeter seal follows a joggling path to avoid at least one effluent stream nozzle.

* * * * *